US009027537B2

(12) United States Patent
Shirabe et al.

(10) Patent No.: US 9,027,537 B2
(45) Date of Patent: May 12, 2015

(54) PCV VALVE INSTALLATION STRUCTURE

(75) Inventors: Takeo Shirabe, Miyoshi (JP); Hitoshi Uema, Iwata (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 13/878,566

(22) PCT Filed: Oct. 19, 2011

(86) PCT No.: PCT/IB2011/002478
§ 371 (c)(1),
(2), (4) Date: Apr. 10, 2013

(87) PCT Pub. No.: WO2012/052820
PCT Pub. Date: Apr. 26, 2012

(65) Prior Publication Data

US 2013/0213370 A1 Aug. 22, 2013

(30) Foreign Application Priority Data

Oct. 21, 2010 (JP) ..... 2010-236710

(51) Int. Cl.
*F02B 13/00* (2006.01)
*F02M 35/10* (2006.01)
(Continued)

(52) U.S. Cl.
CPC ..... *F02M 35/10* (2013.01); *F02M 25/06* (2013.01); *F01M 13/04* (2013.01); *F01M 13/023* (2013.01); *F01M 5/002* (2013.01);
(Continued)

(58) Field of Classification Search
CPC ... F01M 13/04; F01M 13/0011; F02M 25/06; F02B 75/22
USPC ..... 123/574
See application file for complete search history.

(56) References Cited

U.S. PATENT DOCUMENTS 6,412,479 B1 7/2002 Canfield et al.
2001/0010214 A1* 8/2001 Maegawa et al. ..... 123/339.23
(Continued)

FOREIGN PATENT DOCUMENTS

JP 1-262309 10/1989
JP 2003-20925 1/2003
(Continued)

OTHER PUBLICATIONS

Written Opinion of the International Searching Authority in International Application No. PCT/IB2011/002478; Mailing Date: Mar. 2, 2012.
(Continued)

*Primary Examiner* — Lindsay Low
*Assistant Examiner* — Charles Brauch
(74) *Attorney, Agent, or Firm* — Finnegan, Henderson, Farabow, Garrett & Dunner, LLP

(57) ABSTRACT

A positive crankcase ventilation (PCV) valve installation structure for installing a PCV valve of an engine on an engine body includes: a blow-by gas recirculation system that includes a ventilation hose that connects the engine body to an intake device introducing outside air into the engine body and that has a recirculation passage recirculating blow-by gas arising in the engine body to the intake device and an oil cooler device that exchanges heat between lubricating oil and a medium solution that is lower in temperature than the lubricating oil; and a cover that transfers heat of the oil cooler device to the PCV valve.

7 Claims, 7 Drawing Sheets

(51) Int. Cl.

| | |
|---|---|
| ***F01M 5/00*** | (2006.01) |
| ***F01M 13/00*** | (2006.01) |
| *F02M 25/06* | (2006.01) |
| *F01M 13/04* | (2006.01) |
| *F01M 13/02* | (2006.01) |
| *F02B 75/22* | (2006.01) |

(52) U.S. Cl.
CPC .. *F01M 13/0011* (2013.01); *F01M 2013/0027* (2013.01); *F01P 2060/04* (2013.01); *F01P 2060/08* (2013.01); *F02B 75/22* (2013.01)

(56) References Cited

U.S. PATENT DOCUMENTS

| | | | | |
|---|---|---|---|---|
| 2002/0073961 | A1* | 6/2002 | Tanaka et al. | 123/336 |
| 2005/0011504 | A1 | 1/2005 | Ardes | |
| 2009/0241921 | A1* | 10/2009 | Ito et al. | 123/573 |

FOREIGN PATENT DOCUMENTS

| | | |
|---|---|---|
| JP | 2006-70833 | 3/2006 |
| JP | 2007-224736 | 9/2007 |
| JP | 2009-298206 | 12/2009 |

OTHER PUBLICATIONS

Applicant's Response to Written Opinion in International Application No. PCT/IB2011/002478 (Jun. 11, 2012).

Applicant's Response to Telephone Interview in International Application No. PCT/IB2011/002478 (Jul. 12, 2012).

International Preliminary Report on Patentability in International Application No. PCT/IB2011/002478; Completion Date: Jul. 23, 2012.

* cited by examiner

PCV VALVE INSTALLATION STRUCTURE

CROSS-REFERENCE TO RELATED APPLICATIONS

This application is a national phase application of International Application No. PCT/IB2011/002478, filed Oct. 19, 2011, and claims the priority of Japanese Application No. 2010-236710, filed Oct. 21, 2010, the content of both of which is incorporated herein by reference.

BACKGROUND OF THE INVENTION

1. Field of the Invention

The invention relates to a positive crankcase ventilation (PCV) valve installation structure of a blow-by gas recirculation system provided for an internal combustion engine and, more particularly, to a PCV valve installation structure in an internal combustion engine equipped with an oil cooler device that cools lubricating oil.

2. Description of Related Art

In general, a blow-by gas recirculation system for returning blow-by gas to an intake system is provided for an internal combustion engine (hereinafter, simply referred to as engine) mounted on an automobile, or the like. In addition, there is a V-engine in which cylinder banks are arranged in a V shape centering on a crankshaft as one type of the engine of an automobile. Then, a blow-by gas recirculation system is also provided for the V-engine as well.

In a related art, there is known a blow-by gas recirculation system that is provided for such a V-engine and in which, as shown in FIG. 7, PCV valves 100 and 101 are attached to corresponding cylinder head covers 102 and 103 (for example, see Japanese Patent Application Publication No. 2007-224736 (JP-2007-224736)). For example, in a left bank 105 of such a V-engine 104, an existing blow-by gas recirculation system 106 includes a separator case 107 that is provided for the cylinder head cover 102 and that separates blow-by gas and oil mist from each other, the left PCV valve 100 that emits the blow-by gas separated by the separator case 107 and a left blow-by gas supply tube 108 that couples the left PCV valve 100 to an intake pipe at a portion downstream of a throttle valve. In addition, in a right bank 109 of the V-engine 104, an existing blow-by gas recirculation system 110 includes a separator case 111 that is provided for the cylinder head cover 103, the right PCV valve 101 that emits blow-by gas separated by the separator case 111 and a right blow-by gas supply tube 112 that couples the right PCV valve 101 to the intake pipe at a portion downstream of the throttle valve. These two PCV valves 100 and 101 are exposed to an engine room.

With such a configuration, in the blow-by gas recirculation systems 106 and 110, for example, when the left PCV valve 100 of the left bank 105 is open and the right PCV valve 101 of the right bank 109 is closed, blow-by gas blown through a gap between a cylinder 113 and a piston 114 into a crank chamber 115 in a compression cycle or expansion cycle of the V-engine 104 is introduced into the separator case 107 via a blow-by gas passage 116 and cam chamber 117 of the left bank 105. Blow-by gas from which oil mist is separated and removed by the separator case 107 flows out to the left blow-by gas supply tube 108 via the left PCV valve 100, and is introduced into the intake pipe at a portion downstream of the throttle valve.

On the other hand, there is suggested a blow-by gas recirculation system that is provided for a V-engine and that has a breather between left and right banks (for example, see Japanese Patent Application Publication No. 2006-70833 (JP-A-2006-70833)). In this blow-by gas recirculation system, blow-by gas that has reached a breather chamber from a crank chamber is separated into gas and liquid in the breather chamber. Then, blow-by gas from which oil mist is separated is emitted through a blow-by gas introducing hole formed above the breather chamber.

However, in the existing blow-by gas recirculation systems 106 and 110 in which the PCV valves 100 and 101 are respectively provided for the cylinder head covers 102 and 103 as described above, the PCV valves 100 and 101 are exposed to the engine room, and the PCV valves 100 and 101 do not have a heating mechanism, such as a heater, so there is a problem that the PCV valves 100 and 101 may freeze because of running wind while the automobile equipped with the blow-by gas recirculation systems 106 and 110 is running in an environment below freezing. When the PCV valves 100 and 101 freeze, blow-by gas is not emitted from the crank chamber 115, so degradation of lubricating oil may be facilitated.

In addition, in the existing blow-by gas recirculation system having the breather chamber between the left and right banks as described above, the PCV valve is assumed to be installed at a blow-by gas introducing hole above the breather chamber, so, as in the case where the PCV valves 100 and 101 are respectively provided for the cylinder head covers 102 and 103 as described above, the PCV valve may freeze because of running wind while an automobile equipped with the blow-by gas recirculation system is running in an environment below freezing.

On the other hand, in order to prevent freeze of the PCV valve, it is conceivable to provide a heating mechanism, such as a heater, around the PCV valve; however, in this case, the number of components increases to lead to a complex configuration and increased component cost.

SUMMARY OF THE INVENTION

The invention provides a PCV valve installation structure that is able to efficiently suppress freeze of the PCV valve due to running wind while an automobile is running in an environment below freezing without an increase in the number of components.

An aspect of the invention relates to a positive crankcase ventilation (PCV) valve installation structure for installing a PCV valve of an internal combustion engine on an engine body. The PCV valve installation structure includes: a blow-by gas recirculation system that includes: a ventilation hose that connects the engine body to an intake device introducing outside air into the engine body and that has a recirculation passage recirculating blow-by gas arising in the engine body to the intake device; and the PCV valve that is installed on the engine body and that opens or closes the recirculation passage of the blow-by gas; a heat exchanger that exchanges heat between lubricating oil and a medium solution that is lower in temperature than the lubricating oil; and a heat transfer portion that transfers heat of the heat exchanger to the PCV valve.

With the above configuration, while an automobile equipped with the internal combustion engine is running, heat of the heat exchanger is transferred to the PCV valve by the heat transfer portion, so, even when outside air enters an engine room while the automobile is running in an environment below freezing, the possibility that the PCV valve freezes is considerably reduced. By so doing, the PCV valve is hard to freeze in comparison with the structure that the PCV valve is simply installed at an existing cylinder head or between the left and right banks, it is possible to suppress degradation of the lubricating oil when blow-by gas is not emitted because of a clogging due to freeze of the PCV valve. In addition, the heat exchanger of lubricating oil, equipped for the automobile, is used as a heat source, so it is possible to suppress an increase in component cost in comparison with the case where a heater is installed as a new heat source.

In the PCV valve installation structure according to the above aspect, the heat transfer portion may be a cover of the heat exchanger, and the PCV valve may be installed on the cover. With the above configuration, an additional component other than the existing components does not need to be provided as the heat transfer portion, so it is possible to suppress an increase in the number of components.

In the PCV valve installation structure according to the above aspect, the PCV valve may be arranged adjacent to the heat exchanger. With the above configuration, in comparison with the case where the PCV valve is located remote from the heat exchanger, it is possible to reduce a heat loss in the heat transfer portion. Thus, it is possible to efficiently suppress freeze of the PCV valve.

The PCV valve installation structure according to the above aspect may further include an inlet pipe that is arranged near the PCV valve and that flows the lubricating oil into the heat exchanger. With the above configuration, heat of lubricating oil flowing through the inlet pipe is transferred to the PCV valve, so it is possible to suppress freeze of the PCV valve.

In the PCV valve installation structure according to the above aspect, the heat exchanger may be an oil cooler device, the oil cooler device may include: an oil cooler body that has a wall partitioning an inner side from an outer side and that flows the lubricating oil through the inner side surrounded by the wall; and a water jacket that surrounds the oil cooler body and that flows the medium solution so as to be in contact with the wall of the oil cooler body from the outer side, and heat of the lubricating oil may be transferred to the medium solution via the wall. With the above configuration, the oil cooler device is utilized to make it possible to prevent freeze of the PCV valve.

In the PCV valve installation structure according to the above aspect, the engine body may be a V-engine having left and right banks, and the heat exchanger and the PCV valve may be arranged between the left and right banks. With the above configuration, the dead space between the left and right banks of the V-engine may be effectively utilized.

In the PCV valve installation structure according to the above aspect, the PCV valve may be arranged at a rear side of the engine body. With the above configuration, when freezing outside air enters from the front of the engine room, the outside air passes around the engine body and various pipes until the outside air reaches the PCV valve located at the rear side of the engine, so the outside air is heated and exceeds 0° C. when it reaches the PCV valve, so it is possible not to freeze the PCV valve.

The PCV valve installation structure according to the above aspect may further include: a blow-by gas pressure measuring device that measures an atmospheric pressure of the blow-by gas introduced into the PCV valve; and a determining unit that determines that the PCV valve is clogged when the atmospheric pressure measured by the blow-by gas pressure measuring device is higher than a reference value.

Another aspect of the invention relates to a positive crankcase ventilation (PCV) valve installation structure for installing a PCV valve of an internal combustion engine on an engine body. The PCV valve installation structure includes: a blow-by gas recirculation system that includes: a ventilation hose that connects the engine body to an intake device introducing outside air into the engine body and that has a recirculation passage recirculating blow-by gas arising in the engine body to the intake device; and the PCV valve that is installed on the engine body and that opens or closes the recirculation passage of the blow-by gas; and a heat exchanger that exchanges heat between lubricating oil and a medium solution that is lower in temperature than the lubricating oil, wherein the PCV valve is arranged adjacent to the heat exchanger.

Here, in an existing art, work for checking whether the PCV valve remains closed because of freeze or a clogging with sludge, or the like, is, for example, conducted in such a manner that, in the case of the PCV valve formed of a one-way valve, a hose for supplying blow-by gas, which is connected to the PCV valve, is pinched and released during idling of the engine to make determination on the basis of whether the PCV valve gives operating sound like chattering or the PCV valve is removed and then air is blown into or drawn into the PCV valve to determine whether air conducts only in one direction. However, with the above described configuration according to the aspect of the invention, for example, the blow-by gas pressure at which the PCV valve should originally open is set as a reference value. By so doing, when the blow-by gas pressure measuring device detects a blow-by gas pressure that exceeds the reference value, it is possible to detect that there is an abnormal clogging in the PCV valve. Thus, it is possible to easily conduct work for checking for a clogging of the PCV valve.

According to the aspects of the invention, the heat transfer portion that transfers heat of the heat exchanger to the PCV valve is provided to transfer heat of the heat exchanger to the PCV valve, so it is possible to provide a PCV valve installation structure that is able to efficiently suppress freeze of the PCV valve due to running wind while an automobile is running in an environment below freezing without an increase in the number of components.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, first and second embodiments of the invention will be described with reference to the accompanying drawings. In the first and second embodiments, a PCV valve installation structure according to the aspect of the invention is applied to an engine of an automobile.

First Embodiment

Figure 1:
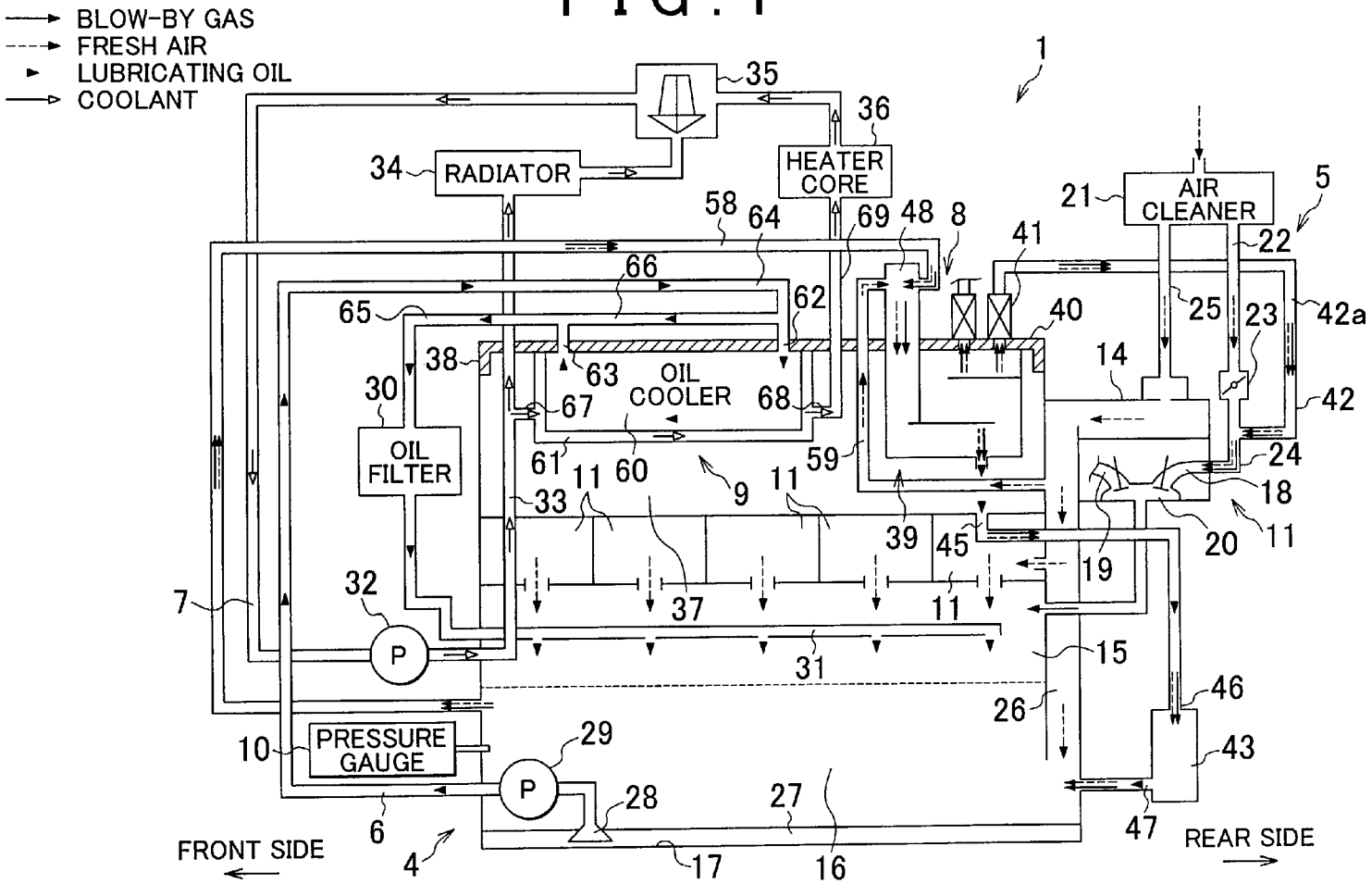
FIG. 1 is a schematic view of an engine having a PCV valve installation structure according to a first embodiment of the invention.
Figure 2:
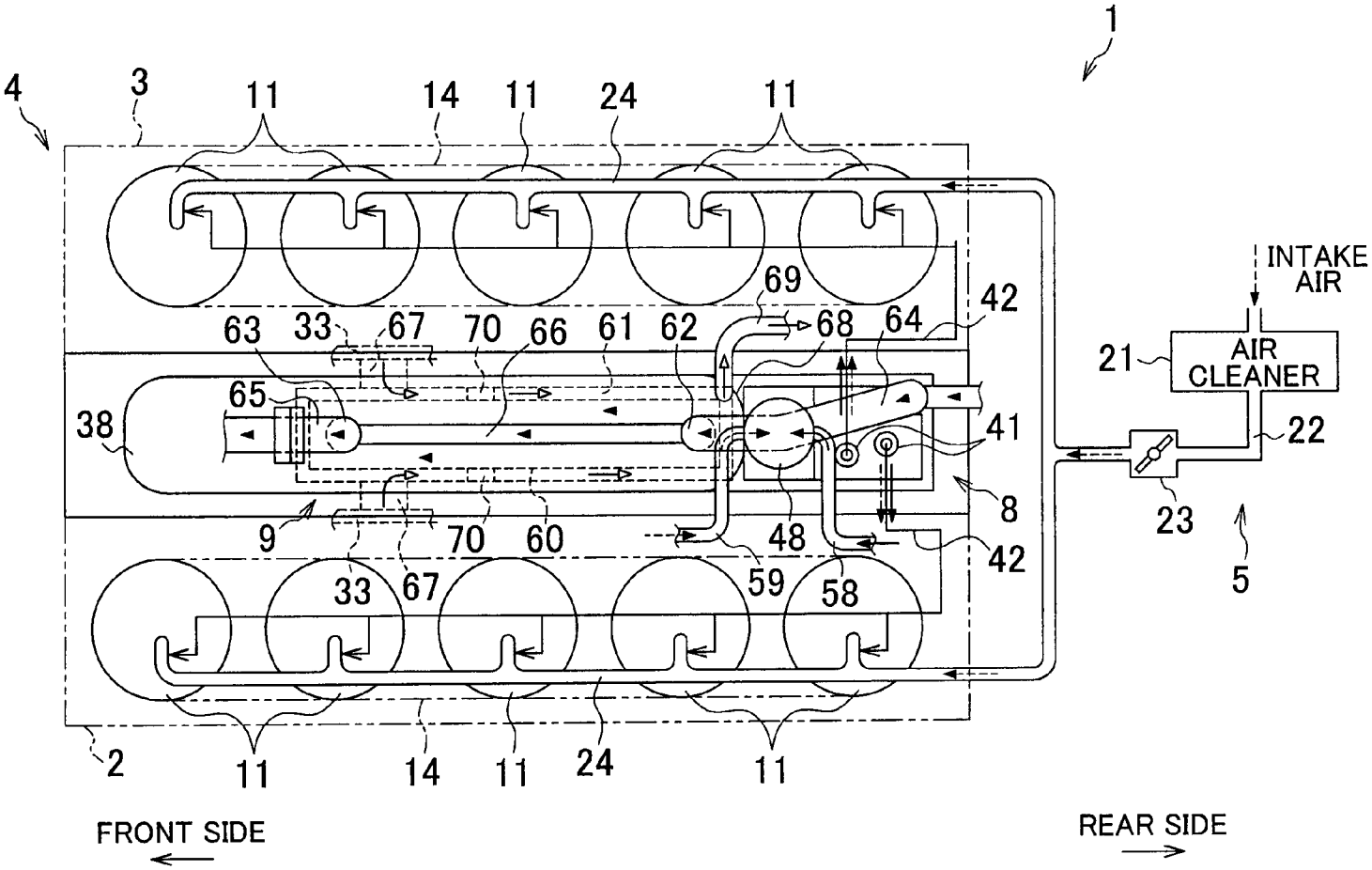
FIG. 2 is a schematic plan view of an engine body having the PCV valve installation structure according to the first embodiment of the invention.

First, the configuration of the first embodiment will be described. As shown in FIG. 1 and FIG. 2, an engine 1 is a V-ten gasoline engine that includes a left bank 2 and a right bank 3. The left bank 2 and the right bank are respectively provided at the left and right sides in a V shape. The engine 1 includes an engine body 4, an intake device 5, an exhaust device (not shown), a lubricating device 6, a cooling device 7, a blow-by gas recirculation system 8 and an oil cooler device 9. FIG. 1 is a schematic longitudinal cross-sectional view of the engine body 4 when viewed from its side. FIG. 1 shows five cylinders 11 inside the engine body 4, and illustrates one of the cylinders 11 at the rear portion of the engine body 4. However, actually, the cylinders 11 are not installed at the rear portion of the engine body 4, but, as shown in FIG. 2, five cylinders 11 are arranged in each of the left and right banks 2 and 3 in the longitudinal direction, and the engine body 4 includes ten cylinders 11. Each of the cylinders 11 is coupled to the intake device 5 and the exhaust device.

The engine body 4 includes a cylinder head 14, a cylinder block 15, a crankcase 16, pistons, a crankshaft, connecting rods, an oil pan 17 and a pressure gauge 10. The pistons are accommodated in the cylinder block 15. The connecting rods respectively couple the pistons to the crankshaft. The oil pan 17 is provided at the lower portion of the crankcase 16. The pressure gauge 10 serves as a blow-by gas pressure measuring device and measures the atmospheric pressure inside the crankcase 16.

The engine body 4 is mounted on a vehicle body via an engine mount (not shown). In addition, the cylinder head 14 has intake ports 18, exhaust ports 19 and combustion chambers 20. The intake ports 18 and the exhaust ports 19 are in communication with the corresponding cylinders 11. The intake device 5 is connected to the cylinder head 14, and intake air is supplied to each combustion chamber 20 via the corresponding intake port 18. In addition, the exhaust device is connected to the cylinder head 14, and exhaust gas in each combustion chamber 20 is emitted via the corresponding exhaust port 19.

The intake device 5 includes an air cleaner 21, an intake pipe 22, a throttle valve 23 and intake manifolds 24. The air cleaner 21 purifies intake air. Intake air from the air cleaner 21 flows through the intake pipe 22. The throttle valve 23 is provided at a downstream portion of the intake pipe 22, and adjusts the flow rate of intake air supplied into each combustion chamber 20. The intake manifolds 24 are connected to the intake pipe 22 to flow intake air into each intake port 18. In addition, the intake device 5 includes a head intake pipe 25 and a communication passage 26. The head intake pipe 25 couples the air cleaner 21 to the cylinder head 14. The communication passage 16 extends from the cylinder head 14 and communicates with the crankcase 16 through the inside of the cylinder block 15.

The lubricating device 6 includes a strainer 28, an oil pump 29, an oil filter 30 and a flow passage 31. The strainer 28 is used to draw lubricating oil 27 stored in the oil pan 17. The oil pump 29 discharges the lubricating oil 27 drawn from the strainer 28 to supply the lubricating oil 27 to the oil cooler device 9. The oil filter 30 filters the lubricating oil 27 drained from the oil cooler device 9. The flow passage 31 supplies the filtered lubricating oil 27 to various portions of the engine body 4. The lubricating path of the lubricating oil 27 starts from the oil pan 17, passes through the strainer 28, the oil pump 29, the oil cooler device 9, the oil filter 30 and the flow passage 31, and returns to the oil pan 17.

The cooling device 7 includes a coolant pump 32, cooling passages 33, a radiator 34, a thermostat 35 and a heater core 36. The cooling passages 33 are used to cool various portions of the engine body 4. The radiator 34 air-cools coolant. When the temperature of the coolant is higher than or equal to a predetermined temperature, the thermostat 35 conducts to flow coolant. The heater core 36 uses coolant heated by the oil cooler device 9 as a heat source. The cooling path of part of coolant starts from the coolant pump 32, passes through the cooling passages 33, the radiator 34 and the thermostat 35, and returns to the coolant pump 32. In addition, the cooling path of the other part of coolant starts from the coolant pump 32, passes through the cooling passages 33, the oil cooler device 9, the heater core 36 and the thermostat 35, and returns to the coolant pump 32.

Here, in the thermostat 35, the path from the heater core 36 to the coolant pump 32 is normally open, and the path from the radiator 34 to the coolant pump 32 is opened or closed depending on the temperature of coolant flowing therethrough. That is, when the temperature of coolant is lower than a predetermined value (when the engine is just started), the path from the radiator 34 to the coolant pump 32 is closed to prevent overcooling of coolant. In addition, when the temperature of coolant is higher than the predetermined value (when the engine is sufficiently warmed up), the path from the radiator 34 to the coolant pump 32 is opened to cool coolant by the radiator 34.

As shown in FIG. 2, the blow-by gas recirculation system 8 and the oil cooler device 9 are installed adjacent to each other between the left and right banks 2 and 3.

As shown in FIG. 1 and FIG. 2, the blow-by gas recirculation system 8 includes a PCV chamber 37, a cover 38 of the PCV chamber 37, a separator case 39, PCV valves 41, ventilation hoses 42 and an oil reservoir 43. The PCV chamber 37 is formed between the left and right banks 2 and 3. The separator case 39 is integrated with the cover 38, and separates blow-by gas and the lubricating oil 27 into gas and liquid. The PCV valves 41 are respectively provided at gas emission ports 40 of the separator case 39. The ventilation hoses 42 each have a recirculation passage 42*a* that couples each PCV valve 41 to the corresponding intake manifold 24 and that recirculates blow-by gas to the corresponding intake manifold 24. The oil reservoir 43 stores the lubricating oil 27 drained to the PCV chamber 37 and returns the lubricating oil 27 to the oil pan 17.

Figure 5:
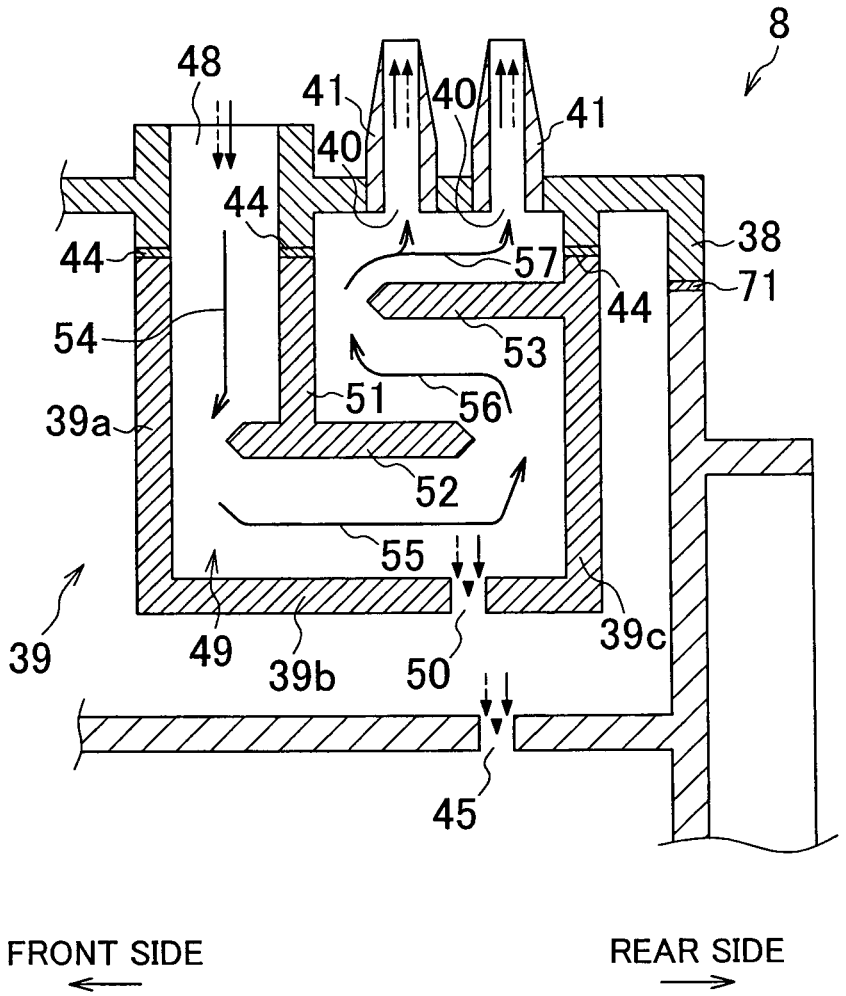
FIG. 5 is a central longitudinal cross-sectional view of a separator case having the PCV valve installation structure according to the first embodiment of the invention.

The PCV chamber 37 is a top-open box formed just above the crankcase 16, and is formed over substantially all the range in the longitudinal direction of the engine body 4. The cover 38 closes the PCV chamber 37 from the upper side. The separator case 39 is integrally attached to the rear portion on the back side of the cover 38. As shown in FIG. 5, a gasket 44 is interposed between the cover 38 and the separator case 39. An oil recovery hole 45 is provided at the bottom portion of the PCV chamber 37. The lubricating oil 27 drained from the separator case 39 flows down through the oil recovery hole 45. The oil reservoir 43 has an upper introducing port 46 and a lower drain port 47. The oil recovery hole 45 is connected to the introducing port 46 of the oil reservoir 43. The drain port 47 of the oil reservoir 43 is connected to the crankcase 16.

The separator case 39 is surrounded by a front wall 39*a*, a bottom wall 39*b*, a rear wall 39*c* and left and right walls (not shown), and the top of the separator case 39 is hermetically sealed by the cover 38 attached via the gasket 44. In addition, the separator case 39 has a separator introducing port 48, a flow passage 49, the gas emission ports 40 and an oil drain port 50. The separator introducing port 48 is used to introduce blow-by gas and fresh air. The flow passage 49 flows these gases to separate the gases into gas and liquid. The gas emission ports 40 emit separated blow-by gas and fresh air. The oil drain port 50 drains separated oil. The separator introducing port 48 extends upward as a vertical linear passage configuration so as to penetrate through the cover 38. The oil drain port 50 is provided at the bottom wall 39*b* of the separator case 39, and extends substantially vertically downward so as to penetrate through the bottom wall 39*b*. The gas emission ports 40 extend upward as a vertical linear passage configuration so as to penetrate through the cover 38.

The flow passage 49 is defined by a longitudinal plate 51, a first lateral plate 52 and a second lateral plate 53. The longitudinal plate 51 faces the front wall 39*a* of the separator case 39 and extends downward from the separator introducing port 48. The first lateral plate 52 faces the bottom wall 39*b* of the separator case 39, and extends rearward from the lower end portion of the longitudinal plate 51. The second lateral plate 53 faces the upper side of the first lateral plate 52, and extends forward from the rear wall 39*c* of the separator case 39.

The flow passage 49 includes a downward passage 54, a first rearward passage 55, a forward passage 56 and a second rearward passage 57. The downward passage 54 extends downward from the separator introducing port 48 between the front wall 39*a* of the separator case 39 and the longitudinal plate 51 to the bottom wall 39*b* of the separator case 39. The first rearward passage 55 extends rearward from the lower end portion of the downward passage 54 between the bottom wall 39*b* of the case and the first lateral plate 52 to the rear wall 39*c*. The forward passage 56 extends upward from the rear end portion of the first rearward passage 55, turns the direction, and extends forward between the first lateral plate 52 and the second lateral plate 53 to the longitudinal plate 51. The second rearward passage 57 extends upward from the front end portion of the forward passage 56, turns the direction, and extends rearward between the cover 39 and the second lateral plate 53 to the two gas emission ports 40. In this way, the flow passage 49 is narrow and has many short turns, so the misty lubricating oil 47 frequently collides with the longitudinal plate 51, the first lateral plate 52, the second lateral plate 53 and the walls 39*a*, 39*b* and 39*c* to thereby efficiently separate and remove oil mist.

The PCV valves 41 each are formed as a one-way valve that allows blow-by gas and fresh air having a pressure higher than or equal to a predetermined value to flow only in a direction in which gas is emitted through the gas emission ports 40. In the present embodiment, the two PCV valves 41 are provided on the upper surface of the cover 38. Then, one of the PCV valves 41 is connected to the intake manifold 24 of the left bank 2 by the ventilation hose 42, and the other one of the PCV valves 41 is connected to the intake manifold 24 of the right bank 3 by the ventilation hose 42. In addition, each PCV valve 41 is connected to the corresponding gas emission port 40 having a vertical linear passage configuration from the upper side. Therefore, the PCV valves 41 may be replaced from the upper side of the cover 38.

In addition, as shown in FIG. 1, the separator case 39 and the crankcase 16 are connected by a blow-by gas introducing pipe 58. By so doing, the separator introducing port 48 is in communication with the inside of the crankcase 16. Furthermore, the communication passage 26 from the cylinder head 14 to the crankcase 16 is in communication with the separator introducing port 48 by a fresh air introducing pipe 59. By so doing, fresh air from the communication passage 26 passes through the fresh air introducing pipe 59 and is introduced from the separator introducing port 48 into the separator case 39 to thereby make it possible to push out blow-by gas.

The recovery path of blow-by gas leaked through a gap between the pistons and the cylinders into the crankcase 16 starts from the cylinder block 15, passes through the crankcase 16, the blow-by gas introducing pipe 58, the separator case 39, the PCV valves 41, the intake manifolds 24 and the intake ports 18, and reaches the combustion chambers 20.

Figure 3:
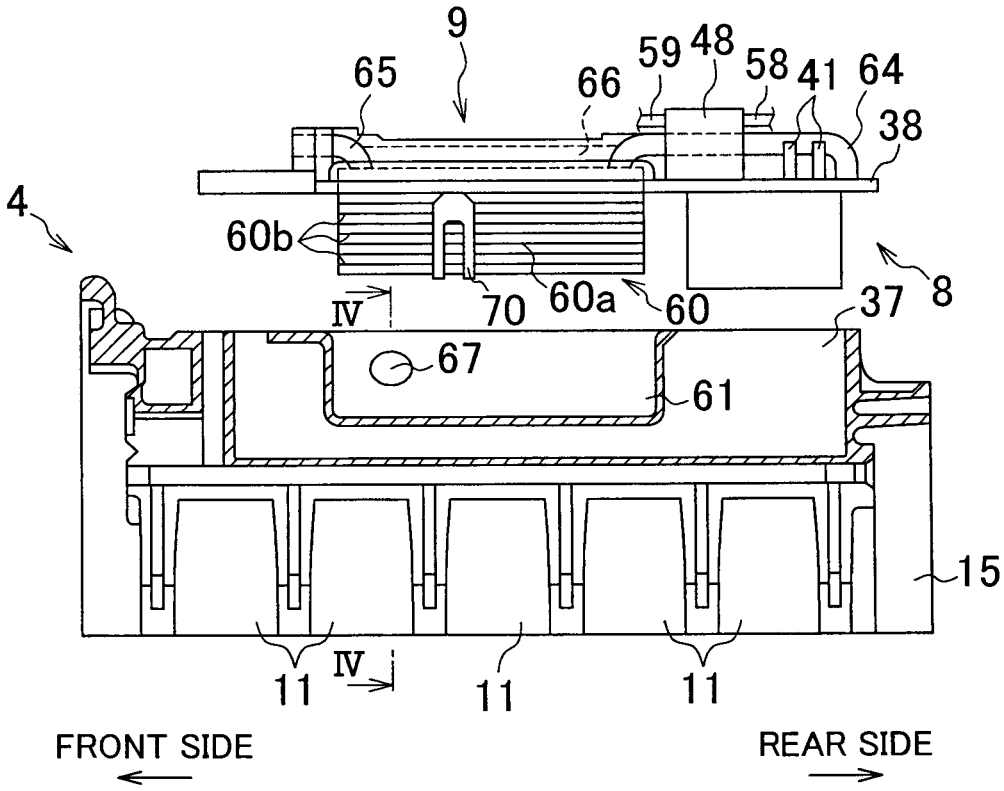
FIG. 3 is an exploded view that shows a blow-by gas recirculation system and oil cooler device that have the PCV valve installation structure according to the first embodiment of the invention.
Figure 4:
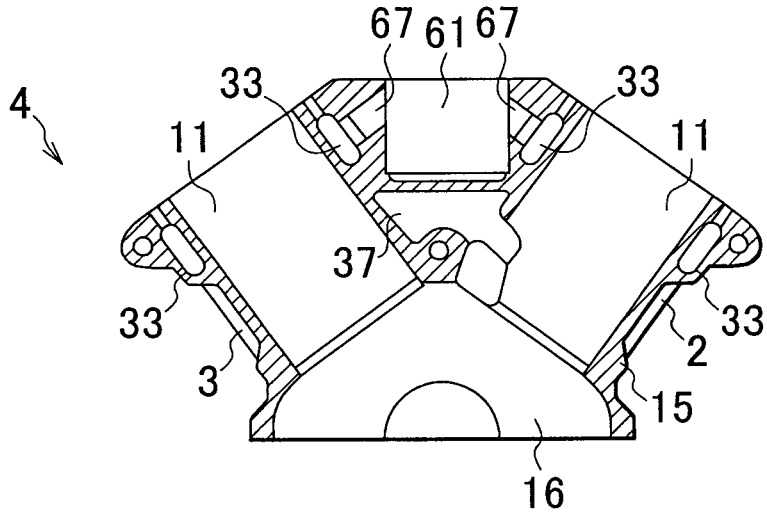
FIG. 4 is a cross-sectional view of a cylinder block, taken along the line IV-IV in FIG. 3.

As shown in FIG. 3, the oil cooler device 9 includes an oil cooler body 60 and a water jacket 61. The oil cooler body 60 has a wall 60*a* that partitions an inner side from an outer side. The lubricating oil 27 flows through the inner side surrounded by the wall 60*a*. The water jacket 61 surrounds the oil cooler body 60, and flows coolant so as to be in contact with the wall 60*a* of the oil cooler body 60 from the outer side. Then, heat of the lubricating oil 27 is transferred to coolant via the wall 60*a*.

The oil cooler body 60 closely adheres to the back side of the cover 38 via a gasket (not shown). The oil cooler body 60 has an oil introducing port 62 and an oil drain port 63. The oil introducing port 62 penetrates through the cover 38 and is provided at the rear top portion. The oil drain port 63 penetrates through the cover 38 and is provided at the front top portion. The oil introducing port 62 is connected to the oil pump 29 of the lubricating device 6 by an introducing port-side pipe 64 that serves as an inlet pipe. As shown in FIG. 2, the introducing port-side pipe 64 is provided so as to pass near the PCV valves 41 above the cover 38. In addition, the oil drain port 63 is connected to the oil filter 30 of the lubricating device 6 by a drain port-side pipe 65. These introducing port-side pipe 64 and drain port-side pipe 65 are connected to each other by a by-pass pipe 66 above the cover 38. A large number of horizontal fin-shaped radiator plates 60*b* are formed on the outer side portion of the wall 60*b* of the oil cooler body 60 to increase contact area with coolant to thereby enhance the efficiency of heat transfer.

The water jacket 61 is integrally formed with the PCV chamber 37, and is formed in a top-open box shape. The water jacket 61 is installed so that the upper end portion closely adheres to the back side of the cover 38 via a gasket 71. The water jacket 61 has coolant introducing ports 67 and a coolant drain port 68. The coolant introducing ports 67 are formed at both side portions at the front side of the water jacket 61. The coolant drain port 68 is provided at the rear side of the water jacket 61. The coolant introducing ports 67 formed at both side portions are respectively connected to parts of the cooling passages 33 formed in the left and right banks 2 and 3. In addition, the coolant drain port 68 extends upward through the cover 38, and is connected to the heater core 36 by a coolant drain pipe 69. In addition, a spacer 70 is provided between the oil cooler body 60 and the water jacket 61. The spacer 70 is used to ensure a gap between the outer surface of the oil cooler body 60 and the inner surface of the water jacket 61.

Here, a structure for installing the PCV valves 41 in the present embodiment is formed of the blow-by gas recirculation system 8, the oil cooler device 9 and the cover 38. These respectively correspond to the blow-by gas recirculation system, the heat exchanger and the heat transfer portion in the PCV valve installation structure according to the aspect of the invention.

Furthermore, in the present embodiment, the operation of the engine 1 is controlled by an electronic control unit (ECU) (not shown) that serves as a determining unit. In the ECU, a pressure at which the PCV valves 41 open is set to a reference value, the pressure gauge 10 is used to measure the blow-by gas pressure in the crankcase 16 during operation of the engine 1, and, when it is detected that the internal pressure of the crankcase 16, that is, the internal pressure of the separator case 39, is higher than the reference value, it is determined that at least any one of the PCV valves 41 is clogged and is hard to open.

Subsequently, the procedure of installing the blow-by gas recirculation system 8 and the oil cooler device 9 between the left and right banks 2 and 3 will be described. As shown in FIG. 3, the separator case 39 and the oil cooler body 60 are assembled to the cover 38 in advance. Then, the cover 38 is attached so that the oil cooler body 60 is placed inside the water jacket 61 in the PCV chamber 37. By so doing, an assembly of the cover 38 is just installed between the left and right banks 2 and 3 to thereby make it possible to position and install the separator case 39 and the oil cooler body 60 at an appropriate position. Then, the blow-by gas recirculation system 8 and the oil cooler device 9 are piped to other devices.

Next, the operation of the engine 1 will be described. Dust is removed from intake air by the air cleaner 21, and the intake air flows from the intake pipe 22 to the intake ports 18 via the throttle valve 23 and the intake manifolds 24. On the other hand, blow-by gas and fresh air are supplied to the intake manifolds 24 from the blow-by gas recirculation system 8 via the respective ventilation hoses 42. Therefore, fresh air and blow-by gas are mixedly supplied to the intake ports 18. The mixed gas is burned in the combustion chambers 20. In addition, part of unburned gas in the combustion chambers 20 passes around the pistons and flows from the cylinder block 15 into the crankcase 16.

On the other hand, part of intake air from the air cleaner 21 passes through the head intake pipe 25 and is supplied to the cylinder head 14. Intake air is supplied from the cylinder head 14 to the cylinder block 15 and the crankcase 16 via the communication passage 26. The intake air pushes out blow-by gas inside the cylinder block 15 and the crankcase 16, and causes the blow-by gas to be introduced into the separator case 39 via the blow-by gas introducing pipe 58. At this time, part of fresh air taken in through the air cleaner 21 is introduced into the separator case 39 through the path from the cylinder head 14 via the communication passage 26 to the fresh air introducing pipe 59, and is mixed with blow-by gas.

Blow-by gas introduced into the separator case 39 contains misty lubricating oil 27. Therefore, the misty lubricating oil 27 collides with the longitudinal plate 51, the first lateral plate 52, the second lateral plate 53 and the walls 39*a*, 39*b* and 39*c* to liquefy inside the separator case 39, and is drained through the oil drain port 50 provided at the lower portion. The drained lubricating oil 27 is drained through the oil recovery hole 45 at the lower portion of the PCV chamber 37, and is stored in the oil reservoir 43. In addition, blow-by gas and fresh air separated by the separator case 39 are released by opening the PCV valves 41. The released blow-by gas is supplied to the left and right intake manifolds 24 via the corresponding ventilation hoses 42.

On the other hand, the lubricating oil 27 stored in the oil pan 17 is drawn and discharged by the oil pump 29 via the strainer 28. Part of the discharged lubricating oil 27 flows in from the introducing port-side pipe 64 of the oil cooler device 9, passes through the inside of the oil cooler body 60 and is cooled by coolant, and then flows out from the drain port-side pipe 65. In addition, the other part of the lubricating oil 27 discharged by the oil pump 29 flows from the introducing port-side pipe 64 to the drain port-side pipe 65 via the by-pass pipe 66. Here, the introducing port-side pipe 64 passes near the PCV valves 41, so heat of the lubricating oil 27 is transferred to the PCV valves 41, and the PCV valves 41 are heated. The lubricating oil 27 drained to the drain port-side pipe 65 is filtered by the oil filter 30 and is supplied to the cylinder block 15. Then, the lubricating oil 27 of the cylinder block 15 passes through the crankcase 16 and is stored in the oil pan 17.

In addition, coolant is discharged from the coolant pump 32, passes through the cylinder block 15 to cool the cylinder block 15, and part of the coolant is supplied from the coolant introducing ports 67 of the water jacket 61 of the oil cooler device 9 to the water jacket 61. By so doing, the lubricating oil 27 that flows through the oil cooler body 60 is water-cooled. Coolant is drained through the coolant drain port 68 of the water jacket 61, and is supplied to the heater core 36. Coolant flows through the heater core 36, passes through the thermostat 35, and returns to the coolant pump 32. Here, when the temperature of coolant is lower than a predetermined temperature as in the case of the start of operation of the engine 1, the path from the radiator 34 to the coolant pump 32 in the thermostat 35 is closed. In addition, when the engine 1 is sufficiently heated and the temperature of coolant is higher than or equal to the predetermined value, the path from the radiator 34 to the coolant pump 32 is opened.

On the other hand, the other part of coolant that has passed through the cylinder block 15 flows into the radiator 34. Here, the thermostat 35 is provided downstream of the radiator 34 and coolant flows through the thermostat 35 only when the temperature of coolant is higher than or equal to the predetermined temperature, so coolant flows through the radiator 34 only when the thermostat 35 allows flow of coolant. Coolant that has been cooled by the radiator 34 and that has passed through the thermostat 35 returns to the coolant pump 32.

Here, the oil cooler device 9 is operating during operation of the engine 1, so the heat of the oil cooler device 9 conducts through the cover 38 and reaches the PCV valves 41. That is, the heat of the oil cooler device 9 is transferred to the portion of the cover 38 at which the oil cooler device 9 is installed, and the heat is transferred therefrom along the cover 38. Then, the oil cooler device 9 and the separator case 39 are arranged adjacent and close to each other, so the heat of a portion of the cover 38 near the oil cooler device 9 is transferred to the PCV valves 41 with a minimum heat loss to make it possible to heat the PCV valves 41. Therefore, even when outside air enters an engine room while the automobile is running in an environment below freezing, the possibility that at least any one of the PCV valves 41 freezes may be considerably reduced.

Here, the pressure at which the PCV valves 41 open is set to a reference value. In this case, when the PCV valves 41 normally operate, the PCV valves 41 open to release blow-by gas in the separator case 39 when the gas pressure of the blow-by gas is higher than the reference value, so the atmospheric pressure of blow-by gas will not be higher than the reference value. In contrast to this, when at least any one of the PCV valves 41 is clogged with sludge, or the like, and is hard to open, the at least any one of the PCV valves 41 does not open even when the atmospheric pressure is higher than the reference value. Therefore, the atmospheric pressure of blow-by gas in the separator case 39 may be considerably higher than the reference value. In addition, the internal pressure of the separator case 39 is equivalent to the internal pressure of the crankcase 16 that is located upstream of the separator case 39.

Then, during operation of the engine 1, the pressure gauge 10 is used to measure the atmospheric pressure of blow-by gas in the crankcase 16, and, when it is detected that the internal pressure of the crankcase 16, that is, the internal pressure of the separator case 39, is higher than the reference value, it may be determined that at least any one of the PCV valves 41 is clogged and is hard to open. Note that the result of determination in the case where at least any one of the PCV valves 41 is hard to open is provided to a driver by a display unit, such as a warning lamp.

The structure for installing the PCV valves 41 according to the first embodiment is configured as described above, so the following advantageous effects may be obtained.

That is, during operation of the engine 1, the heat of the oil cooler device 9 conducts through the cover 38 and reaches the PCV valves 41, and the heat of the introducing port-side pipe 64 reaches the PCV valves 41 on the cover 38, so, even when outside air enters the engine room while the automobile equipped with the engine 1 is running in an environment below freezing, the possibility that at least any one of the PCV valves 41 freezes may be considerably reduced. By so doing, the PCV valves 41 are hard to freeze in comparison with the structure that the PCV valves 41 are simply installed at an existing cylinder head or between the left and right banks 2 and 3, it is possible to suppress degradation of the lubricating oil 27 when blow-by gas is not emitted because of a clogging of the PCV valves 41. In addition, the oil cooler device 9 equipped for the automobile is used as a heat source, so it is possible to suppress an increase in component cost in comparison with the case where a heater is installed as a new heat source.

Furthermore, the PCV valves 41 are provided adjacent to the oil cooler device 9, so it is possible to reduce a heat loss in the cover 38 in comparison with the case where the PCV valves 41 are provided remote from the oil cooler device 9, and it is possible to further effectively suppress freeze of the PCV valves 41. Moreover, the PCV valves 41 are arranged at the rear side of the engine body 4, so, when freezing outside air enters from the front of the engine room, the outside air passes around the engine body 4 and various pipes until the outside air reaches the PCV valves 41 located at the rear side of the engine 1. Therefore, outside air is heated and exceeds 0° C. when it reaches the PCV valves 41, so it is possible not to freeze the PCV valves 41.

In addition, the atmospheric pressure of blow-by gas in the crankcase 16 is measured to make it possible to detect a clogging of at least any one of the PCV valves 41, so it is possible to considerably easily conduct checking work for the PCV valves 41, such as not only checking for a frozen PCV valve 41 but also whether at least any one of the PCV valves 41 is clogged with sludge.

Moreover, the PCV valves 41 are installed on the cover 38 between the left and right banks 2 and 3 so as to be replaceable from the upper side, so it is possible to easily replace the PCV valves 41 in comparison with the case where a PCV valve is provided at a portion that is hidden by another cover, or the like, or an inaccessible portion and work for detaching another member is, for example, required in order to replace the PCV valve. Thus, it is possible to considerably easily conduct checking work for the PCV valves 41 in such a manner that the pressure gauge 10 is used to measure the atmospheric pressure of blow-by gas in the crankcase 16, and, if it is detected that at least any one of the PCV valves 41 is clogged as a result of checking, it is possible to easily replace the at least any one of the PCV valves 41.

In addition, the separator introducing port 48 is formed as a vertical linear passage configuration that penetrates through the cover 38, so it is possible to effectively utilize dead space in comparison with the case where the separator introducing port 48 is formed as a configuration that extends in another direction. Furthermore, the blow-by gas recirculation system 8 and the oil cooler device 9 are provided between the left and right banks 2 and 3, so it is possible to effectively utilize the dead space of the V-engine.

Second Embodiment

In an engine 1 according to a second embodiment, a dry sump is employed. Therefore, the oil pan 17 formed in the crankcase 16 according to the first embodiment differs from that of the second embodiment; however, the other components are similarly configured. Thus, the same components as those of the first embodiment shown in FIG. 1 to FIG. 5 will be described using like reference numerals, and the difference will be specifically described in detail.

Figure 6:
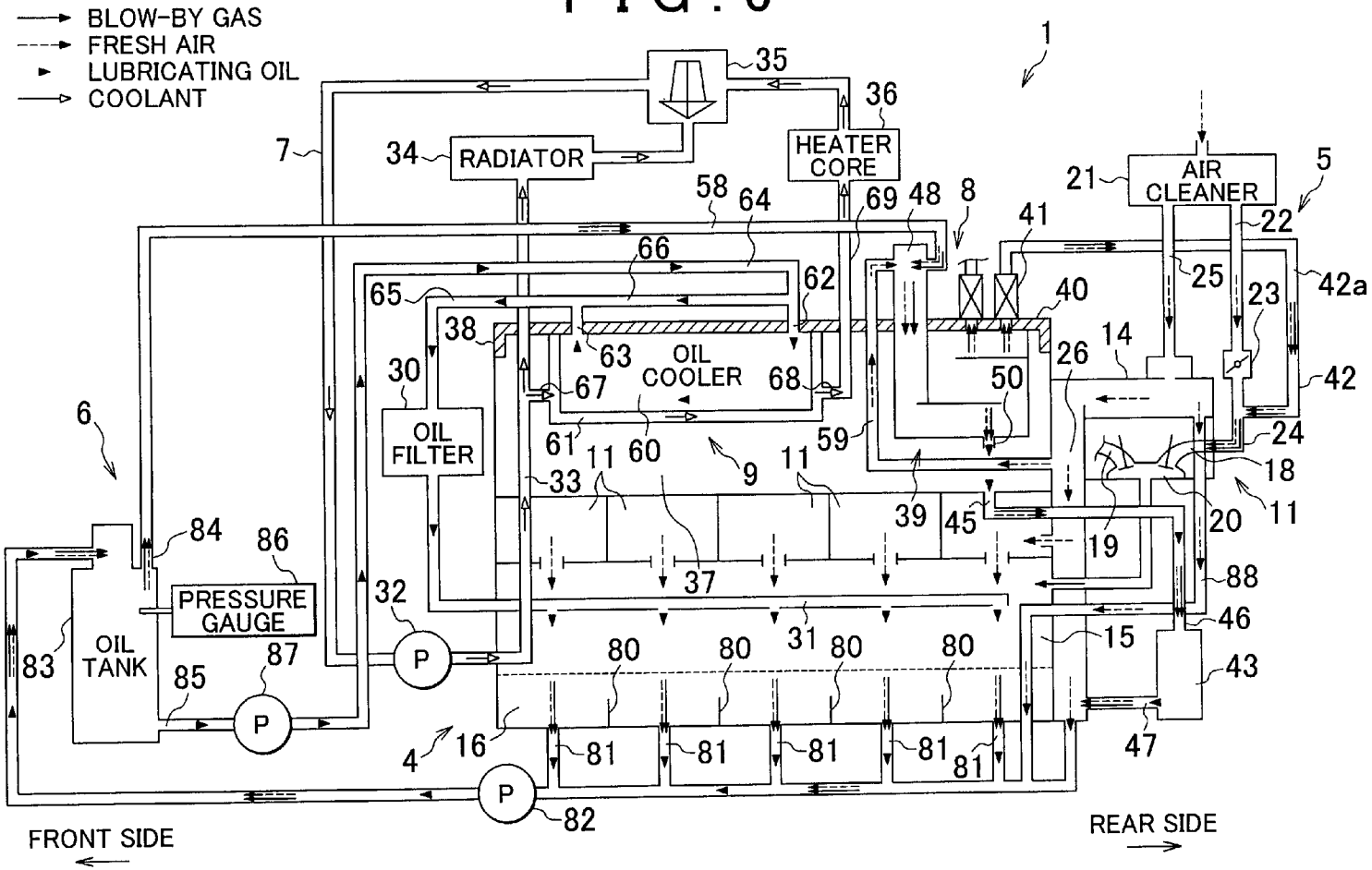
FIG. 6 is a schematic view of an engine having a PCV valve installation structure according to a second embodiment of the invention.
Figure 7:
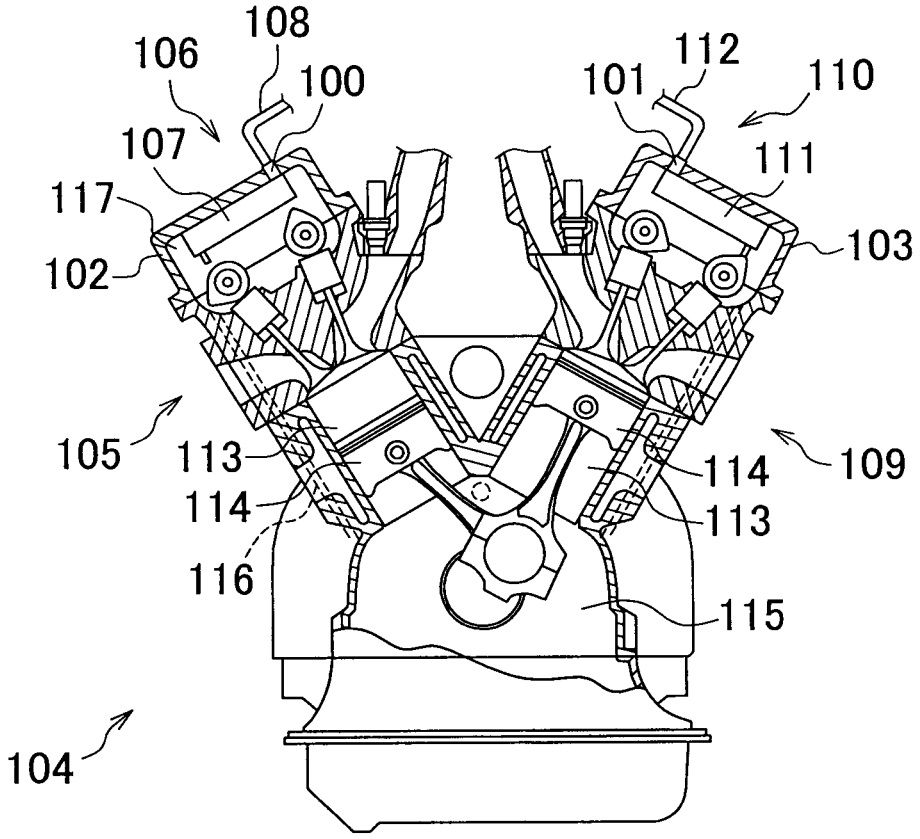
FIG. 7 RELATED ART
FIG. 7 is a cross-sectional view of an engine having an existing PCV valve installation structure.

As shown in FIG. 6, a partition plate 80 is provided at the lower portion of the crankcase 16 for each cylinder 11. Each of the bottom portions of spaces partitioned by the partition plates 80 has a suction hole 81. Furthermore, each suction hole 81 is connected to a scavenge pump 82. The scavenge pump 82 is used to draw blow-by gas and fresh air in the crankcase 16 and lubricating oil stored at the bottom portion. At this time, the bottom portion of the crankcase 16 is partitioned by the partition plates 80, so lubricating oil may be efficiently drawn even when a lateral load is applied to the engine 1. These blow-by gas, fresh air and oil are stored in an oil tank 83 from the scavenge pump 82.

The oil tank 83 has a gas emission port 84 formed at an upper portion and an oil drain port 85 formed at a lower portion. The gas emission port 84 is connected to the separator introducing port 48 of the separator case 39 by the blow-by gas introducing pipe 58. Therefore, blow-by gas and fresh air pushed out through the gas emission port 84 are introduced into the separator case 39.

Furthermore, a pressure gauge 86 is provided for the oil tank 83. The pressure gauge 86 is used to measure the internal atmospheric pressure. The internal pressure of the separator case 39 is equivalent to the internal pressure of the oil tank 83 that is located upstream of the separator case 39. Therefore, the pressure gauge 86 is used to measure the atmospheric pressure of blow-by gas in the oil tank 83 to thereby make it possible to measure the internal pressure of the separator case 39. By so doing, it is possible to determine whether at least any one of the PCV valves 41 is clogged and is hard to open.

In the present embodiment, the lubricating device 6 includes the oil tank 83, the oil pump 87, the oil filter 30, the flow passage 31 and the scavenge pump 82. The oil tank 83 is provided outside the engine body 4. The oil pump 86 discharges lubricating oil supplied from the oil tank 83 and supplies the lubricating oil to the oil cooler device 9. The oil filter 30 filters the lubricating oil drained from the oil cooler device 9. The flow passage 31 supplies the filtered lubricating oil to various portions in the engine body 4. The scavenge pump 82 draws lubricating oil stored at the bottom portion of the crankcase 16. The lubricating path starts from the oil tank 83, passes through the oil pump 87, the oil cooler device 9, the oil filter 30, the flow passage 31, the crankcase 16 and the scavenge pump 82, and returns to the oil tank 83.

Blow-by gas arises in the combustion chambers 20. The recovery path of the blow-by gas starts from the combustion chambers 20, and passes through the cylinder block 15, the crankcase 16, the scavenge pump 82, the oil tank 83, the separator case 39, the PCV valves 41, the intake manifolds 24, the intake ports 18, and returns to the combustion chambers 20.

In addition, the communication passage 26 from the cylinder head 14 to the crankcase 16 is directly connected to the scavenge pump 82. Furthermore, separately from the communication passage 26, a fresh air introducing passage 88 that couples the cylinder head 14 to the scavenge pump 82 is provided. By so doing, a large amount of fresh air may be introduced from the scavenge pump 82 into the oil tank 83.

The structure for installing the PCV valves 41 according to the second embodiment is configured as described above, so the following advantageous effects may be obtained.

That is, because the dry sump is employed as described above, lubricating oil may be stably stored in the oil tank 83, a friction loss may be reduced, for example, biasing or foaming of lubricating oil in the crankcase 16 may be prevented, and lubricating oil may be stably supplied to lubricated portions of the engine body 4.

In addition, as in the case of the first embodiment, during operation of the engine 1, the heat of the oil cooler device 9 conducts through the cover 38 and reaches the PCV valves 41, and the heat of the introducing port-side pipe 64 reaches the PCV valves 41 on the cover 38, so, even when outside air enters the engine room while the automobile equipped with the engine 1 is running in an environment below freezing, the possibility that at least any one of the PCV valves 41 freezes may be considerably reduced.

Furthermore, the PCV valves 41 are provided adjacent to the oil cooler device 9, so it is possible to reduce a heat loss in the cover 38 in comparison with the case where the PCV valves 41 are provided remote from the oil cooler device 9, and it is possible to further effectively suppress freeze of the PCV valves 41.

In addition, the atmospheric pressure of blow-by gas in the crankcase 16 is measured to make it possible to detect a clogging of at least any one of the PCV valves 41, so it is possible to considerably easily conduct checking work for the PCV valves 41, such as not only checking for a frozen PCV valve 41 but also whether at least any one of the PCV valves 41 is clogged with sludge. Moreover, the PCV valves 41 are installed on the cover 38 between the left and right banks 2 and 3 so as to be replaceable from the upper side, so it is possible to easily replace the PCV valves 41.

Here, in the above described structures for installing the PCV valves 41 according to the first and second embodiments, the PCV valves 41 are installed at the rear portion of the engine body 4; instead, in the PCV valve installation structure according to the aspect of the invention, the position at which the PCV valves 41 are installed may be another portion, and may be, for example, at the front portion or center portion of the engine body 4.

In addition, in the structures for installing the PCV valves 41 according to the first and second embodiments, each PCV valve 41 is formed of a one-way valve; however, in the PCV valve installation structure according to the aspect of the invention, each of the PCV valves 41 is not limited to a mechanical one-way valve. Each of the PCV valves 41 may be an electromagnetic valve that may be electrically controlled to open or close or that is able to electrically control the flow rate.

In addition, in the structures for installing the PCV valves 41 according to the first and second embodiments, the pressure gauge 10 or 86 is used to detect whether at least any one of the PCV valves 41 is hard to open; instead, in the PCV valve installation structure according to the aspect of the invention, the pressure gauge 10 or 86 may be omitted.

Furthermore, in the structures for installing the PCV valves 41 according to the first and second embodiments, the engine 1 is of a V-ten type; instead, in the PCV valve installation structure according to the aspect of the invention, the engine 1 may be of another type, and may be, for example, of a V-six type, a V-eight type or an in-line type other than a V type. When the engine 1 is of an in-line type, there is no space between the banks 2 and 3 as described in the present embodiments, so, for example, a blow-by gas recirculation system and an oil cooler device are installed at a side portion of an engine body, or the like.

As described above, the PCV valve installation structure according to the aspect of the invention is able to prevent freeze of the PCV valve at low cost without providing another member, such as a heater, even when freezing outside air blows into an engine room, and is useful in all the PCV valve installation structures suitable for the case where an automobile used in cold climate areas includes a blow-by gas recirculation system.

The invention claimed is:

1. A positive crankcase ventilation (PCV) valve installation structure for installing a PCV valve of an internal combustion engine on an engine body, comprising:

a blow-by gas recirculation system that includes: a ventilation hose that connects the engine body to an intake device introducing outside air into the engine body and that has a recirculation passage recirculating blow-by gas arising in the engine body to the intake device; and the PCV valve that is installed on the engine body and that opens or closes the recirculation passage of the blow-by gas;

a heat exchanger that exchanges heat between lubricating oil and a medium solution that is lower in temperature than the lubricating oil; and a heat transfer portion that transfers heat of the heat exchanger to the PCV valve, wherein the heat transfer portion is a cover of the heat exchanger, and the PCV valve is installed on the cover, the heat exchanger is an oil cooler device, the oil cooler device includes: an oil cooler body that has a wall partitioning an inner side from an outer side and that flows the lubricating oil through the inner side surrounded by the wall; and a water jacket that surrounds the oil cooler body and that flows the medium solution so as to be in contact with the wall of the oil cooler body from the outer side, and heat of the lubricating oil is transferred to the medium solution via the wall, and the oil cooler body is positioned adjacent to a back surface of the cover.

2. The PCV valve installation structure according to claim 1, wherein the PCV valve is arranged adjacent to the heat exchanger.

3. The PCV valve installation structure according to claim 1, further comprising an inlet pipe that is arranged near the PCV valve and that flows the lubricating oil into the heat exchanger.

4. The PCV valve installation structure according to claim 1, wherein the PCV valve is arranged at a rear side of the engine body.

5. The PCV valve installation structure according to claim 1, further comprising:

a blow-by gas pressure measuring device that measures an atmospheric pressure of the blow-by gas introduced into the PCV valve; and a determining unit that determines that the PCV valve is clogged when the atmospheric pressure measured by the blow-by gas pressure measuring device is higher than a reference value.

6. The PCV installation structure according to claim 1, wherein the oil cooler body is positioned inside of a PCV chamber that is closed by the cover.

7. A positive crankcase ventilation (PCV) valve installation structure for installing a PCV valve of an internal combustion engine on an engine body, comprising:

a blow-by gas recirculation system that includes: a ventilation hose that connects the engine body to an intake device introducing outside air into the engine body and that has a recirculation passage recirculating blow-by gas arising in the engine body to the intake device; and the PCV valve that is installed on the engine body and that opens or closes the recirculation passage of the blow-by gas;

a heat exchanger that exchanges heat between lubricating oil and a medium solution that is lower in temperature than the lubricating oil; and a heat transfer portion that transfers heat of the heat exchanger to the PCV valve, wherein the heat transfer portion is a cover of the heat exchanger, and the PCV valve is installed on the cover, the heat exchanger is an oil cooler device, the oil cooler device includes: an oil cooler body that has a wall partitioning an inner side from an outer side and that flows the lubricating oil through the inner side surrounded by the wall; and a water jacket that surrounds the oil cooler body and that flows the medium solution so as to be in contact with the wall of the oil cooler body from the outer side, and heat of the lubricating oil is transferred to the medium solution via the wall, and the engine body is a V-engine having left and right banks, and the oil cooler body and the PCV valve are arranged between the left and right banks.

* * * * *